US005146625A

United States Patent [19]

Steele et al.

[11] Patent Number: 5,146,625

[45] Date of Patent: Sep. 15, 1992

[54] COOLING VEST

[75] Inventors: Sandra L. Steele, Kingston; Harry W. Nettleton, Hansville, both of Wash.

[73] Assignee: Steele And Associates, Inc., Kingston, Wash.

[21] Appl. No.: 676,092

[22] Filed: Mar. 27, 1991

[51] Int. Cl.[5] ..... A41D 1/04

[52] U.S. Cl. ..... 2/102; 2/92; 2/49 R; 2/247; 2/250; 2/DIG. 7; 128/402

[58] Field of Search ..... 2/102, 92, 49 R, DIG. 7, 2/247, 250; 272/119; 128/402, 403, 178, 399

[56] References Cited

U.S. PATENT DOCUMENTS

| | | | |
|---|---|---|---|
| D. 293,618 | 1/1988 | Berenson | D2/190 |
| 2,748,391 | 6/1956 | Lewis et al. | 2/2.5 |
| 3,409,907 | 11/1968 | Barratt | 2/2.5 |
| 4,608,717 | 9/1986 | Dunbavand | 2/2.5 |
| 4,697,285 | 10/1987 | Sylvester | 2/2.5 |
| 4,718,124 | 1/1988 | Sawicki et al. | 2/114 |
| 4,964,173 | 10/1990 | Gordon et al. | 2/114 |
| 4,989,267 | 2/1991 | Watson | 2/102 |
| 5,038,779 | 8/1991 | Barry et al. | 2/102 |

FOREIGN PATENT DOCUMENTS

| | | | |
|---|---|---|---|
| 3521813 | 1/1987 | Fed. Rep. of Germany | 2/2 |

*Primary Examiner*—Werner H. Schroeder
*Assistant Examiner*—Gloria Hale

[57] ABSTRACT

A cooling vent having opposed front and back panels to substantially cover a user's torso, the panels being non-integral along at least a first side and a first shoulder. First shoulder connector means allows the front and back panels to be releasably connected to one another such that the first shoulder can open or close. A plurality of elongated pockets are provided on at least one of the panels and preferably both, each of which has an opening to receive a cooling pack into the pocket. By virtue of the foregoing open side and shoulder construction, the vest can be removed sideways after use allowing a user to wear protective headgear, such as a gas mask, until after the vest is removed and without having to attempt to remove the vest over their head. In one embodiment, each pocket has inner and outer walls, each wall having a structural layer and an insulation layer. The insulation layer of the inner wall inhibits too rapid cooling of the user's torso which might otherwise occur, while the cooling by the gel packs.

15 Claims, 2 Drawing Sheets

COOLING VEST

FIELD OF THE INVENTION

The present invention relates to a cooling vest which assists in cooling a user.

TECHNOLOGY REVIEW

Vests as an article of clothing are, of course, well know and a variety of designs exist for such vests as well as vests for various protective purposes. For example, U.S. Pat. Nos. 2,748,391 to Lewis, 3,409,907 to Barratt, 4,608,717 to Dunbavand, and 4,697,285 to Sylvester all disclose shrapnel or ballistics or similar type vests of various constructions. On the other hand, U.S. Pat. No. 293,618 discloses a particular design for a buoyant swim vest. Although the ballistics vest of the Sylvester '285 patent apparently has adjustable shoulder straps held in place by adjustable fasteners, neither that vest nor the vests of any of the other foregoing patents are provided with a plurality of pockets each with an opening therein, to receive respective cooling packs.

A one piece cooling vest has been marketed by Steele Incorporated of Kingston, Wash. under the trademark STEELEVEST, which vest has a plurality of horizontal pockets, each having an opening to accommodate a cooling pack therein. Such a vest helps relieve heat stress a user may otherwise experience. The construction of the foregoing vest allows pre-cooled cooling packs (of a cooling gel formulation) to be slid into respective pockets. In such position, the cooling packs are essentially adjacent a user's body except for an intervening fabric layer of the vest and the user's clothes. The cooling packs thus assist in cooling a user's body The foregoing vest has split sides with front and back panels integrally connected over the shoulders.

SUMMARY OF THE INVENTION

While the design of the STEELEVEST cooling vest is very useful in many situations, it requires that the vest be placed on, or removed from, a user over their head. Such a maneuver is difficult or impossible when the user is wearing head gear, such as a bulky gas mask. Furthermore, it has been discovered that for many applications, when that cooling vest is snugly worn by a user, the cooling packs initially provide cooling at a rate which is too high and which then decreases to a rate which is too low in an undesirably short period of time. This is apparently since the cooling packs are separated from a user's body by only the fabric layer of the vest and the user's clothing (which in many cases will be light).

Accordingly, the present invention provides a cooling vest with opposed front and back panels to substantially cover the front and back of a user's torso. The panels are non-integral along a first side of the vest and on a first shoulder (it will be understood that the "first shoulder" and "first side" are on the same side of the vest). "Non-integral" as used throughout the present application refers to two parts not being unitary or fixedly connected as to prevent them being parted in normal use of the vest. Thus, two parts joined or joinable by releasable fasteners connected thereto (eg. hook and loop fasteners) are "non-integral". The panels can be non-integral along both sides of the vest and on both shoulders, however the preferred construction is to have both sides non-integral and one shoulder only non-integral. A first shoulder connector means adjacent the first shoulder allows the front and back panels to releasably connect to one another adjacent the first shoulder. A plurality of elongated pockets are provided on at least one of the panels, each pocket having an opening such that cooling packs can be received in respective pockets. Some embodiments of the present invention include the cooling packs.

It is preferred that the pockets be substantially horizontal with respective, substantially vertical, end openings to receive the cooling packs therethrough. Terms such as "horizontal", "vertical" or similar terms are used throughout this application in a relative sense typically referring to orientation when the vest is in normal use worn by a user. The first shoulder connector means preferably comprises overlapping segments of the panels and a hook and loop releasable connector, such as of the type sold under the trademark VELCRO, disposed between those segment, and further preferably comprises a tab which can be pulled to release the connector. The tab is of sufficient size that it can be readily grasped by a user even when wearing relatively bulky gloves (i.e. the tab should be at least about 6 cm long and about 3 cm wide). The vest may additionally be provided with two straps extending from preferably the rear panel to overlap strap receiving portions on the other panel to varying extents. Releasable strap holders (hook and loop fasteners disposed between the straps and receiving portions, being preferred) thus allow the vest to snugly fit users of various sizes.

The vest also may have at least one (and preferably several) insulation layer which extends about the entire inside of the garment. Such insulation prefer comprises a layer of fibrous material sandwiched between thin layers of a material coated with a metallized film.

DRAWINGS

Embodiments of the invention will now be described with reference to the drawings in which.

DETAILED DESCRIPTION OF EMBODIMENTS OF THE INVENTION

Figure 1:
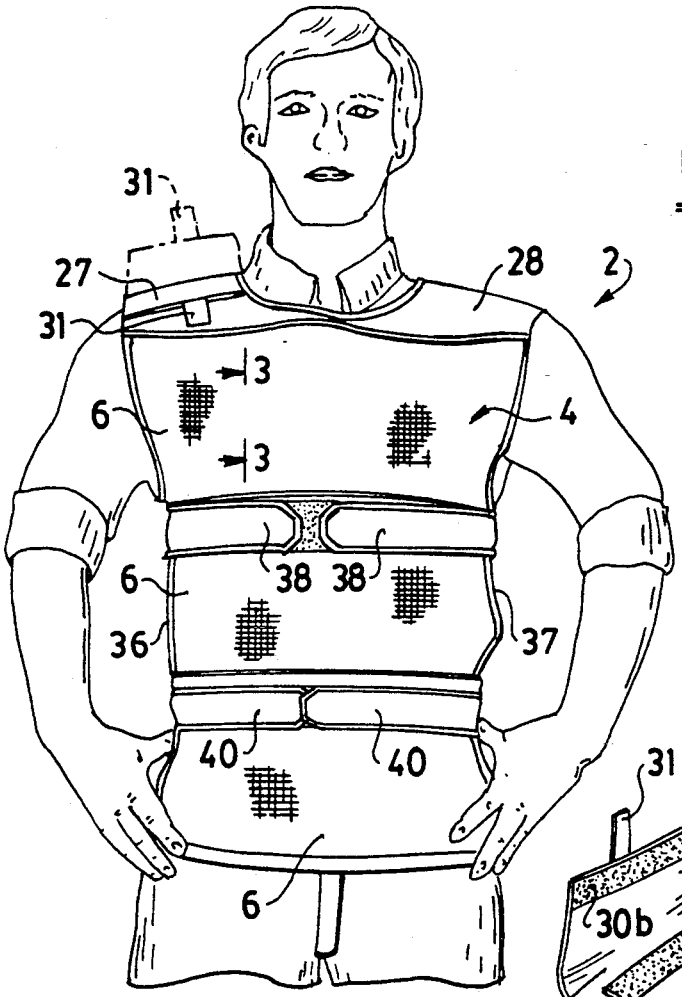
FIG. 1 is front view showing a user wearing a cooling vest of the present invention.
Figure 2:
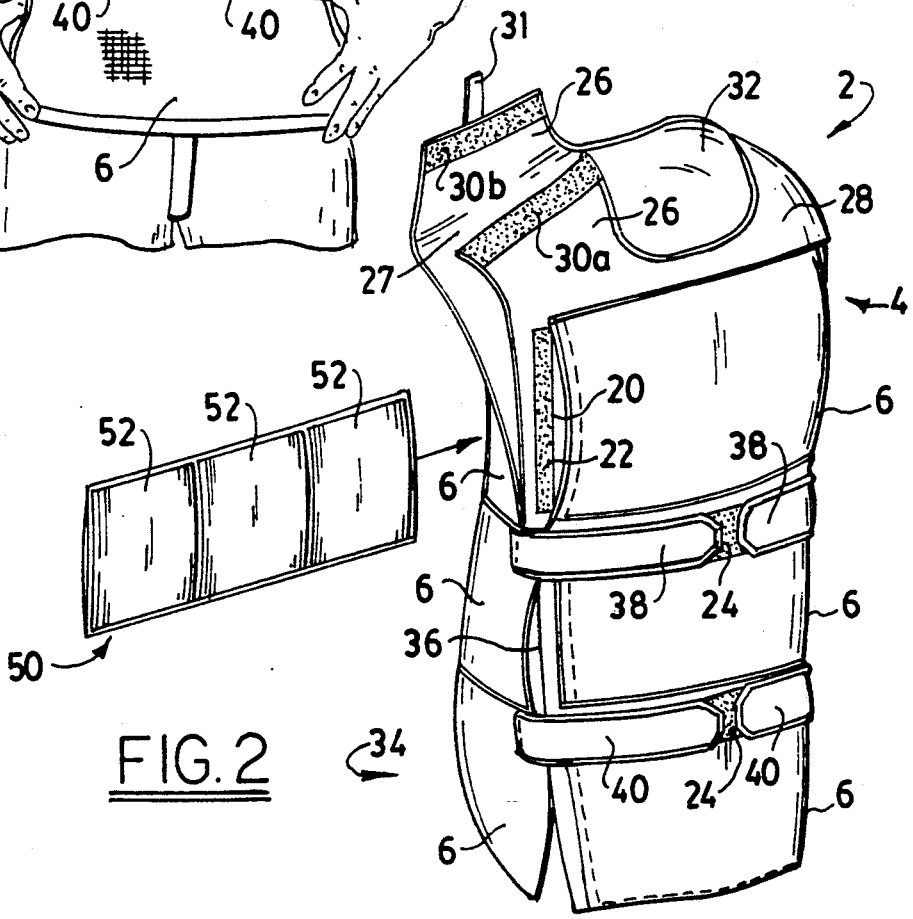
FIG. 2 is a perspective view of the vest shown in FIG. 1 with one of the cooling gel packs removed.

Referring first to FIGS. 1 and 2, the vest 2 of the present invention has opposed front and back panels 4 and 34, respectively. Each panel 4, 34 has three horizontally disposed, elongated pockets 6 each of which can receive an elongated cooling gel pack 50 (only one of which is shown in FIG. 2) through an opening 20 in pocket 4. Each opening 20 has a hook and loop fastener means 22 such that each opening 20 can be closed to releasably retain a gel pack 50 therein. Vest 2 has a non-integral first shoulder 27 defined by segments 26 and an integral second shoulder 28, as well as neck opening 32. The first shoulder 27 carries a tab 31 approximately 3 cm wide and 6 cm long. The dimensions of tab 31 are not critical, it being sufficiently large so that it can be grasped by a glove hand (i.e. it should be no smaller than about 3 cm wide by about 6 cm long.

Segments 26 carry hook and loop fastener members 30*a*, 30*b* such that the first shoulder 27 can be opened and closed (the open position being shown in FIG. 2 and in broken lines in FIG. 1, while the closed position is shown in solid lines in FIG. 1). The hook member 30b is located on the upper one of segments 26, while loop member 30a is located on the lower one of segments 26. Such an arrangement is more comfortable for a user since their face may come in contact with loop member 30a during use, and the hook member tends to have a more abrasive texture than the loop member. Each of first side 36 and second side 37 of vest 2 is non-integral, with two pairs of straps 32, 40 extending from adjacent side edges of back panel 34. Straps 32, 40 and portions 24 of front panel 4 which the straps can overlap, carry respective elements of hook and loop fastener means. Such hook and loop fastener means are, for convenience of manufacture, of the same width as fastener members 30a, 30b. By such arrangement, when vest 2 is worn by a user, straps 38 and 40 can be pulled to overlap portions 24 to a sufficient extent to hold vest 2 snugly against the user's body, and held in such positions by the hook and loop fasteners.

Figure 3:
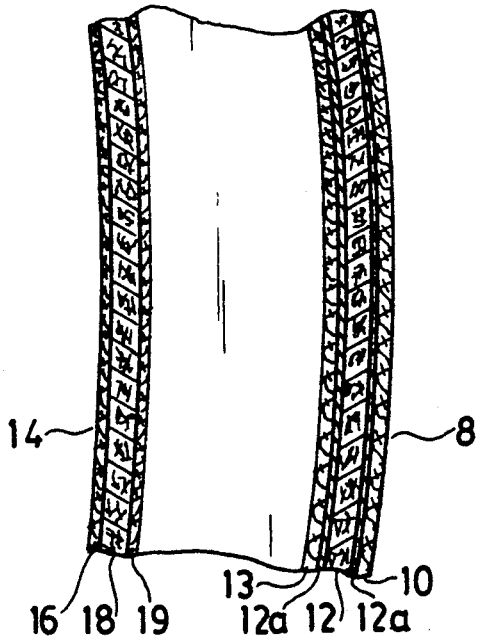
FIG. 3 is a vertical cross section along line 3—3 in FIG. 1, which shows the pocket construction in more detail.

Referring to FIG. 3 in particular, each pocket 6 has inner and outer walls 8, 14, respectively. Outer wall 8 has an outside structural layer in the form of fabric layer 10 (which is the base material for vest 2), made of a durable flame resistant cotton of about 9 ounces/square yard and about 1 mm thickness. Alternatively, outer wall 8 may be made of a material of a type such as that sold by DuPont Corporation under the trademark NOMEX, which is a flame retardant ceramic material having a density of about 6 ounzes/square yard with about 1 mm thickness). Outer wall 8 also includes insulation in the form of layer 12 sandwiched between two layers 12a. Layer 12 is an approximately 1 cm thick layer of a fibrous material (65% polyolefin, 35% polyester; 4.6 ounces/square yard), preferably that sold by 3M Company under the trademark THINSULATE Type C150. Layers 12a consists of a layer of metallized polyolefin with holes therethrough to facilitate breathing of vest 2. A suitable material for layers 12a is that sold by Apex Mills, N.Y. under the trademark TEXOLITE. Outer layer 8 further has a layer 13 made of nylon tricot. It should be noted that the various layers of outer wall 8 extend throughout vest 2 (except, of course, inner wall 14). Inner wall 14, on the other hand, has an outside structural layer in the form of fabric layer 16, an insulation layer 18 an inside layer 19. Fabric layer 16 is of the same material as that of layer 10 of outer wall 8, while insulation layer 18 is the same as layer 12, and layer 19 is of the same as layer 13.

Each gel pack 50 consists of a plastic sheet formed into three individual pouches 52, as best seen in FIG. 2. Each pouch 52 contains a polyethylene bag which in turn contains a gel mixture of fairly high heat capacity, such types of gel mixtures being well known for cooling packs for other purposes. A preferred gel composition is one consisting of 100 parts pre gelatinized corn starch, 25 parts of a stabilizing agent such as borax, 800 parts of water, 3 parts of a mold inhibiting agent which may also enhance gel strength, and sufficient soluble mineral salt to lower the freezing point of the gel to approximately 28° F. The gel should have a specific heat of approximately 0.88 and a heat of fusion of approximately 120. The gel should not require more than 170 b.t.u. per pound to freeze it at a temperature of 30° F.

To use vest 2 of the present invention, six gel packs 50 would first be pre-cooled (preferably frozen) in a freezer. The user, who would normally at least be wearing one layer of clothing on their torso, would insert the six gel packs 50 into the open vertical openings 20 of respective pockets 6. Hand pressure would then be applied to hook and loop fasteners 22 to close openings 20 and retain gel packs 50 in their respective pockets. Prior to donning vest 2, hook and loop fasteners between straps 38, 40 and portions 24, and between segments 26 would typically be in the unfastened position so that first side 36, second side 37 and first shoulder 27 are open. The user can then simply slip vest 2 sideways from right to left as viewed toward FIG. 1, onto their torso with their neck passing through the first open shoulder. Straps 38, 40 can then be pulled to bring vest 2 snugly against the user's torso, and straps 38, 40 then held in positions by engaging respective hook and loop fasteners between them and portions 24 which they overlap. Likewise, hook and loop fastener elements 30 on segments 26 can be engaged to close the first shoulder 27.

When worn as described, vest 2 can then keep the user cool for several hours, depending upon the ambient temperature, humidity, clothing worn and the user's activity. In this regard insulation layers 12 and 12a (which extend about the entire vest 2) reduce heat transfer to gel packs 50 from ambient air, layers 12a primarily operating by means of reflection from the metallic film thereon. Layers 13 and 19, on the other hand, provide structurally strong, but breathable, inside surfaces. Insulation layer 16 is particularly important in promoting a more .a even heat transfer from the user to gel packs 50 over time. Absent insulation layer 16, it has been found in practice that with a user wearing a single thin layer of clothing, such as a shirt, a user would initially feel too cool with the cooling effect decreasing relatively rapidly with time. Insulation layer 16, which is used to insulate gel packs 50 from the user (a construction which might normally be thought of as contrary to the objective of a cooling vest) inhibits such rapid initial cooling and therefore promotes comfort and duration of cooling effect.

The fact that pockets 6 are distinct from one another allows relatively vertical bending by the user and at the same time reduces sagging of the gel which may occur, were there only a single larger pocket on each panel 4, 34. The fact that gel packs 50 are segmented into three horizontal pouches 52 allows easier user flexing in the horizontal direction than if pack 50 was one continuous strip.

When it is desired to remove vest 2, a user simply pulls on tab 31 to open first shoulder 27 and then releases straps 38, 40 from segments 24 to open sides first side 36 and second side 37. The non-integral construction of first shoulder 27 now allows the user to slip vest 2 sideways and off their torso. This ability to slip vest 2 off sideways, as enabled by the combination of non-integral first side 36 and first shoulder 27, is particularly important since in some cases the user may also be wearing head gear such as breathing equipment (eg. gas mask). It is often desirable, as a safety measure, to remove such equipment last. Such would be difficult, if not impossible, without non-integral side 36 and first shoulder 27 since vest 2 would have to be removed over the user's head.

It will be appreciated that various modifications and alterations can be made to the specific embodiments of the invention described above in detail. Accordingly, the present invention is not limited to such specific embodiments.

I claim:

1. A cooling vest comprising:

(a) opposed front and back panels to substantially cover the front and back of a user's torso, said panels being non-integral along a first side of the vest and non-integral on a first shoulder;

(b) first shoulder connector means adjacent the first shoulder allowing the front and back panels to releasably connect to one another adjacent the first shoulder, said first shoulder connector means comprising overlapping segments of the front and back panels, and a hook and loop releasable connector disposed between the overlapping segments; and (c) a plurality of elongated pockets on at least one of the panels, each of said pockets having an opening such that respective elongated cooling packs can be received therein.

2. A cooling vest comprising:

(a) opposed front and back panels to substantially cover the front and back of a user's torso, said panels being non-integral along a first side of the vest and non-integral on a first shoulder;

(b) first shoulder connector means adjacent the first shoulder allowing the front and back panels to releasably connect to one another adjacent the first shoulder, said first shoulder connector means comprising overlapping segments of the front and back panels, and a hook and loop releasable connector disposed between the overlapping segments;

(c) a plurality of substantially horizontal, elongated pockets on at least one of the panels, each of said pockets having an opening such that respective elongated cooling packs can be received therein.

3. A cooling vest as defined in claim 2 wherein the pockets extend substantially across the entire width of their respective panels.

4. A cooling vest as defined in claim 2 wherein said front and back panels are non-integral along the first side and a second side of the vest.

5. A cooling vest as defined in claim 4 wherein said first shoulder connector means additionally comprises a tab extending from an upper overlapping segment such that pulling on the tab results in release of the connector, said tab being of a sufficient size as to be readily grasped by a gloved hand of a user.

6. A cooling vest as defined in claim 3 wherein said panels are also nonintegral along a second side of the vest and each of said panels has opposite side edges, said vest additionally comprising two straps extendable from adjacent opposite side edges of one of said panels and two releasable strap holders positioned such that the straps can overlap strap receiving portions on the other one of said panels to varying extents and be releasably held in such positions by the strap holder so that the vest can snugly fit users of various sizes.

7. A cooling vest as defined in claim 6 wherein the straps extend from adjacent opposite side edges of the back panel.

8. A cooling vest comprising:

(a) opposed front and back panels to substantially cover the front and back of a user's torso, said panels being non-integral along a first side of the vest and non-integral on a first shoulder;

(b) first shoulder connector means adjacent the first shoulder allowing the front and back panels to releasably connect to one another adjacent the first shoulder, said first shoulder connector means comprising overlapping segments of the front and back panels, and a hook and loop releasable connector disposed between the overlapping segments;

(c) a plurality of elongated pockets on at least one of the panels, each of said pockets having an opening such that respective elongated cooling packs can be received therein; and (d) a plurality of elongated cooling packs received in respective pockets.

9. A cooling vest comprising:

(a) opposed front and back panels to substantially cover the front and back of a user's torso, said panels being non-integral along a first side of the vest and non-integral on a first shoulder;

(b) first shoulder connector means adjacent the first shoulder allowing the front and back panels to releasably connect to one another adjacent the first shoulder, said first shoulder connector means comprising overlapping segments of the front and back panels, and a hook and loop releasable connector disposed between the overlapping segments;

(c) a plurality of substantially horizontal, elongated pockets on at least one of the panels, each of said pockets having an opening such that respective elongated cooling packs can be received therein; and (d) a plurality of elongated cooling packs received in respective pockets.

10. A cooling vest as defined in claim 9 wherein said first shoulder connector means additionally comprises a tab extending from an upper overlapping segment such that pulling on the tab results in release of the connector, said tab being of a sufficient size as to be readily grasped by a gloved hand of a user.

11. A cooling vest as defined in claim 10 wherein said panels are also non-integral along a second side of the vest and each of said panels has opposite side edges, said vest additionally comprising two straps extendable from adjacent opposite side edges of one of said panels and two releasable strap holders positioned such that the straps can overlap strap receiving portions on the other one of said panels to varying extents and be releasably held in such positions by the strap holder so that the vest can snuggle fit users of various sizes.

12. A cooling vest as defined in claim 11 wherein the straps extend from adjacent opposite side edges of the back panel.

13. A cooling vest as defined in claim 1 wherein said front and back panels are non-integral along the first side and a second side of the vest.

14. A cooling vest as defined in claim 13 wherein said first shoulder connector means additionally comprises a tab extending from an upper overlapping segment such that pulling on the tab results in release of the connector, said tab being of a sufficient size as to be readily grasped by a gloved hand of a user.

15. A cooling vest as defined in claim 1 wherein said panels are also nonintegral along a second side of the vest and each of said panels has opposite side edges, said vest additionally comprising two straps extendable from adjacent opposite side edges of one of said panels and two releasable strap holders positioned such that the straps can overlap strap receiving portions on the other one of said panels to varying extents and be releasably held in such positions by the strap holder so that the vest can snugly fit users of various sizes.

* * * * *